US005443563A

United States Patent [19]

Hindel et al.

[11] Patent Number: 5,443,563

[45] Date of Patent: Aug. 22, 1995

[54] ROLLER BLINDS AND PROCESSES FOR THEIR MANUFACTURE

[76] Inventors: Josef Hindel, 47 Black Forest Drive, Richmond Hill, Ontario, Canada, L4E 2N6; Sam Hindel, 17 Vesta Road, Richmond Hill, Ontario, Canada, L2B 2M2

[21] Appl. No.: 43,220

[22] Filed: Apr. 5, 1993

[51] Int. Cl.[6] ..... A47G 5/02

[52] U.S. Cl. ..... 160/238; 160/DIG. 7; 160/264

[58] Field of Search ..... 160/238, 121.1, DIG. 7, 160/370.2 A, 264, 23.1, 127; 101/128.21, 467, 211

[56] References Cited

U.S. PATENT DOCUMENTS

| | | | |
|---|---|---|---|
| 3,015,318 | 5/1961 | Smits et al. | 156/233 |
| 3,017,927 | 1/1962 | Demko | 160/DIG. 7 X |
| 3,186,474 | 6/1965 | Levitas | 160/238 |
| 3,205,118 | 9/1965 | Guffan | 160/238 |
| 3,299,944 | 1/1967 | Gossling et al. | 160/263 |
| 3,913,655 | 10/1975 | Ogino | 160/84 R |
| 4,006,770 | 2/1977 | Ferguson | 160/263 |
| 4,078,492 | 3/1978 | Levy et al. | 160/238 X |
| 4,247,599 | 1/1981 | Hopper | 428/458 |
| 4,391,865 | 7/1983 | Constance | 160/DIG. 7 X |
| 4,397,346 | 8/1983 | Chumbley et al. | 160/DIG. 7 X |
| 4,398,585 | 8/1983 | Marlow | 160/23 R |
| 4,399,855 | 8/1983 | Volfson | 160/23 R |
| 4,539,238 | 9/1985 | Markowitz | 428/43 |
| 4,539,239 | 9/1985 | Graves et al. | 428/43 |
| 4,619,305 | 10/1986 | Comeau | 160/263 |
| 4,637,447 | 1/1987 | Frank et al. | 160/265 |
| 4,649,981 | 3/1987 | Bibeau | 160/120 |
| 4,821,785 | 4/1989 | Rolan | 160/370.2 R X |
| 4,907,636 | 3/1990 | Simon | 160/238 |
| 4,931,342 | 6/1990 | Tolbert et al. | 428/90 |
| 4,951,909 | 8/1990 | Russo et al. | 248/206.2 |
| 4,979,775 | 12/1990 | Klose | 296/97.1 |
| 5,016,770 | 5/1991 | Rizzardi | 215/232 |
| 5,097,761 | 3/1992 | Hamu | 101/127.1 |
| 5,097,885 | 3/1992 | Kitagawa | 160/238 X |
| 5,102,598 | 4/1992 | Chen | 264/140 |
| 5,111,866 | 5/1992 | Prostko | 160/90 |
| 5,117,891 | 6/1992 | Simon | 160/263 |
| 5,121,784 | 6/1992 | Lennard | 160/130 |
| 5,123,473 | 6/1992 | Henkenjohann | 160/264 |

FOREIGN PATENT DOCUMENTS

| | | | |
|---|---|---|---|
| 3823780 | 1/1990 | Germany | 160/121.1 |
| 4019590A1 | 1/1992 | Germany . | |
| 2051936 | 1/1981 | United Kingdom . | |

OTHER PUBLICATIONS

Draco Kirsh, The New Custom Roller Shade Collection, Cooper Window Treatments, Circle No. 112 on Reader Information Card.

*Primary Examiner*—David M. Purol
*Attorney, Agent, or Firm*—Neil H. Hughes; Ivor M. Hughes; Marcelo K. Sarkis

[57] ABSTRACT

A roller window shade (roller window blind) comprising:

(a) a roller; and (b) a shade (blind) secured thereto for being rolled up onto, and rolled down from, the roller, the shade carrying a clear, undistorted, high definition imprint selected from a photograph, picture, icon, logo, trade mark, cartoon character or scene, applied on the face of the shade material, the shade comprising non-stretchable material to make the window shade (blind) non-stretchable.

8 Claims, 8 Drawing Sheets

ROLLER BLINDS AND PROCESSES FOR THEIR MANUFACTURE

FIELD OF INVENTION

This invention relates to new roller type window shades and blinds and processes for their manufacture.

BACKGROUND OF THE INVENTION

Roller type window shades (blinds) are known coverings for windows. They include light penetrating blinds and black-out blinds (effectively blocking out the light from passing through the blind) which are each pulled down to cover the window, for example, at night.

Attempts have been made to decorate the face of the material of the light transmitting (penetrating) blinds (shades). In this regard designs and repeating patterns are applied by a rotary printer to the weave material from which the light transmitting (penetrating) blinds (shades) are made up. The applied designs and patterns are however distorted when applied on the material. Despite this distortion, manufacturers continue to manufacture the light transmitting blinds bearing the designs and patterns. The reason is that people hanging the roller type window shades (blinds) do not want a plain fabric face covering the window area when the blind material is rolled down. The weave of the light transmitting (penetrating) fabric cannot however support a high definition picture or design on its face. The designs or pictures when applied are distorted by the nature of the fabric. Furthermore the light transmission makes the design visible from the outside-a not desirable feature or attribute.

In an attempt to overcome these difficulties with the application of the designs and patterns and in an effort to provide a high definition to the applied design and patterns, vinyl fabric or paper bearing high definition designs and high definition patterns are applied to the light transmitting fabric (and even black out blind material). However the costs of making the roller blinds (shades) bearing their designs are escalated substantially making them less commercially desirable and viable.

In another attempt to apply designs to blinds, manufacturers have applied a design to PVC material (without backing) by a continuing application of a design to the face of the material and thereafter combining the material with a fiberglass layer and a black out layer to form a laminated shade which is then secured to a roller to form a window blind. However it is only possible to manufacture blinds with abstract designs or simple designs for which distortion of the design was not a problem because there was distortion with this process. Because PVC is stretchable any design applied by, for example rotary gravure, or silk screen, printing, would be distorted. Thus photographs (of for example sports celebrities) and pictures (of for example cartoon characters, scenes), logos, icons and the like could not be imprinted on roller blinds, (shades) because of the distortion.

It is therefore an object of this invention to provide new roller window blinds (roller window shades) each presenting a high definition photograph (for example a famous person) and pictures (for example cartoon characters, scenes), trade marks, icons, logos and the like imprinted directly on the material making up the face of the roller blind (shade).

It is a further object of the invention to provide processes for making such roller blinds (shades).

Further and other objects of the invention will be realized by those skilled in the art from the following summary of the invention and detailed description of embodiments thereof.

SUMMARY OF THE INVENTION

According to one aspect of the invention a roller window shade (roller window blind) is provided comprising:

(a) a roller (for example a multi-stop roller [spring shade roller], clutch assembly shade roller (pull chain or electrically operated) and (b) a shade (blind) secured thereto for being rolled up onto, and rolled down from, the roller, the shade carrying a clear, undistorted, high definition photograph, picture, icon, logo, cartoon character, scene, or the like applied (for example imprinted, silk screened, etc.) on the face of the shade material, the shade comprising non-stretchable material to make the window shade (blind) non-stretchable.

In one embodiment the shade presents polyvinyl chloride (PVC) for example manufactured by Oxidental Chemical Corp., P.O. Box 456, Burlington, N.J., U.S.A., 2.5–3.5 mil. or guage or like material (for example a cotton coated fabric sheeting) on both sides of the shade (blind) carrying (for example sandwiching) non-stretchable material which may comprise a woven fiberglass [produced by for example Clark Schwebel Fiberglass Co., P. O. Box 851-C, 5 Corporate Drive, White Plains, N.Y. 10603, U.S.A., under Model Number 1610 and 1640] sandwiched between two sheets of PVC. A layer of black-out material [for example manufactured by Oxidental Chemical Corp. 2.5–3.5 mil or guage] may a be interposed between the non-stretchable material [for example woven fiberglass] and a sheet of PVC for blocking light transmission. Thus the shade [blind] may comprise a pair of opposing PVC sheets sandwiching a layer of woven fiberglass and black-out material to provide a non-stretchable shade or blind secured to a roller.

According to another aspect of the invention a process for the manufacture of a roller window shade [roller window blind] is provided, the roller blind (shade) comprising a take-up roller, a shade (blind) comprising non-stretchable material, and a clear, undistorted, high definition photograph, picture, icon, trade mark, cartoon character, scenes, logo, or the like, the steps of the process comprising, in any order which yields the finished product, (a) assembling a shade to include facing material and non-stretchable material to provide a non-stretchable shade;

(b) applying (for example imprinting) a clear, undistorted, high definition photograph, picture, icon, cartoon character, scene and/or trade mark to the non-stretchable shade; and (c) assembling the shade (blind) to the roller.

The application of a high definition photograph, (for example a photograph of a sports personality) picture etc. may be accomplished by any suitable commercially reproducible process, for example rotary gravure printing, silk screening, transfer print application, lithograph, pad printing, photoengraving, four colour process and line printing or other commercially viable reproducible process which produces clear (undistorted) high definition photographs, pictures, logos, icons, cartoon characters, trade marks and the like. In this regard see *The Complete Printmaker* written by John Ross, Clare Romano and Tim Ross by the Free Press A division of MacMillan Inc., New York, Collin MacMillan Publishers, London which describes techniques referred to herein and which is incorporated herein by reference.

By use of the term "high definition" is meant to convey a photograph, picture, icon, cartoon character, and the like which can be compared to a photograph which is clear and distortion-free.

By use of the expression non-stretchable material in the blind (shade), the blind (shade) material resists stretching so that when the high definition photograph, picture, icon, cartoon character and trademark are applied (for example imprinted) onto the shade (blind) material, there is no distortion. Thus the non-stretchable material resists stretching during the application (for example imprinting) of the for example photograph, picture, icon, cartoon character and trademarks. It need not be non-stretchable beyond those circumstances. Thus the non-stretchable material may be a fiberglass scrim, coated fiberglass, fiberglass mesh, or woven fiberglass, whether tightly or loosely woven, polyester, nylon or the like. Examples of suitable non-stretchable materials are manufactured by Clark Schwebel Fiberglass Co. as woven fiberglass products for example Models 1610 and 1640. Where a black-out material may be interposed within the shade (blind), such material may be for example, an aluminium based PVC formulation comprising aluminum, PVC and other additions or black based PVC. Suitable material is sold by the Oxidental Chemical Corp. (2.5 mil to 3.5 mil).

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 2:
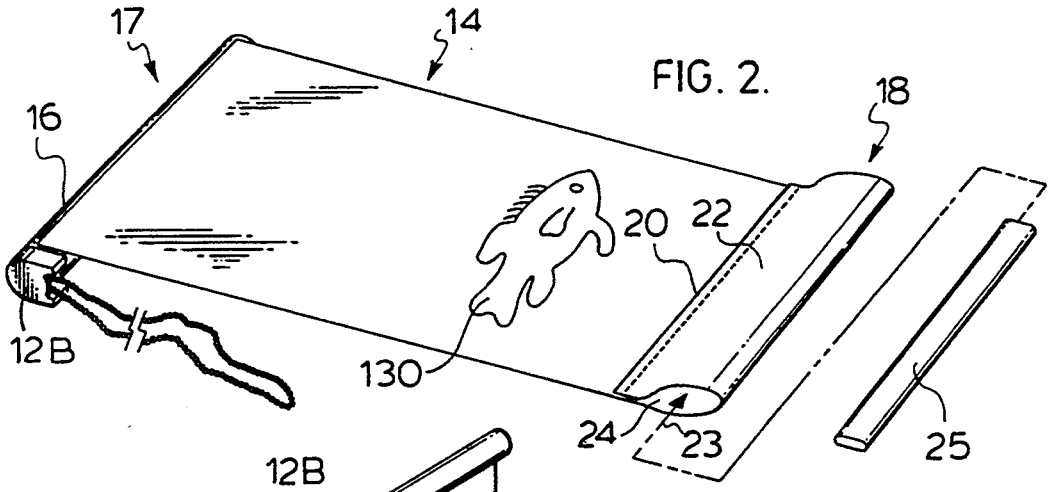
FIG. 2 is a partially exploded view of the blind in FIG. 1 with some components exploded from the blind in which the roller is a clutch assembly roller.
Figure 1:
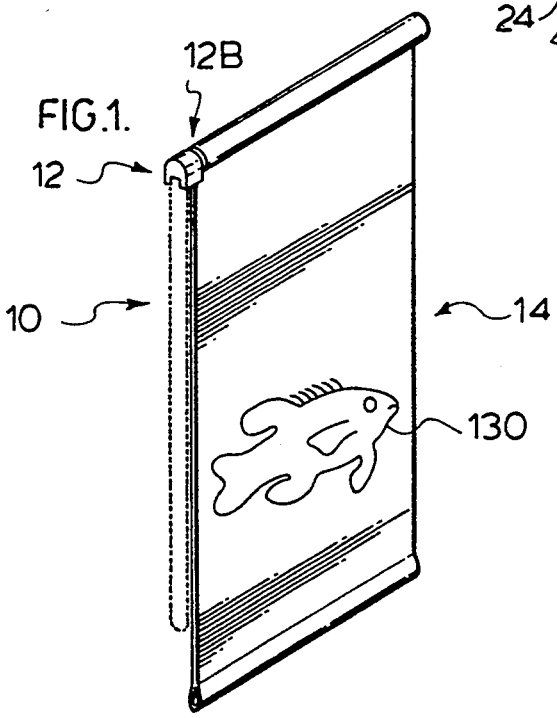
FIG. 1 is a perspective view of a roller blind (shade) according to one embodiment of the invention.
Figure 9:
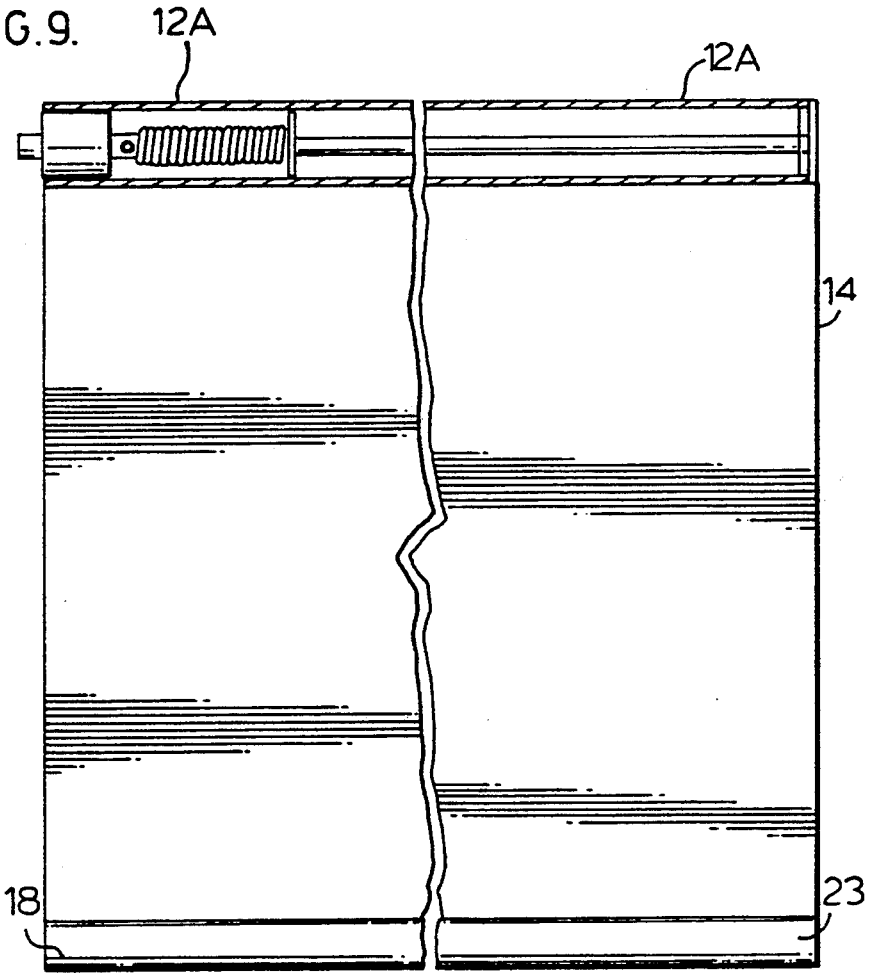
FIG. 9 shown with FIG. 3B is a cross sectional view of a spring shade roller used in a blind.

With reference to FIGS. 1 and 2, there is shown roller blind 10 comprising roller 12 [for example a spring roller 12A manufactured by KIRSCH 309 N. Prospect, Sturgis, Mich. 49091 under model HD 1" and shown in FIG. 9 or clutch roller (gear), manufactured by General Clutch 425 Fairfield Ave. Stamford, Conn. 06902 under model R3 or R8 ($1\frac{1}{8}$"), shown as 12B in FIG. 1, shade (blind) 14, of predetermined width and length [for example 36" wide by 72" long] secured by tape 16 manufactured by 3M Manufacturing ($\frac{3}{8}$ width regular Scotch Tape) at end 17 of the shade (blind) 14 proximate roller 12.

The bottom 18 of shade (blind) 14 is heat sealed or sewn as at 20 to form hem 22, 36" wide and 1" deep to form sleeve 23 for carrying slat 25 36" in length and $\frac{7}{8}$" in width to fit into opening 24 of, and be accommodated within, sleeve 23 (see FIG. 2).

The shade 14 (see FIG. 3A) comprises four separate sheets of material-outer sheets of PVC material 28 and 30 (2.5 to 3.5 mil) manufactured by Oxidental Chemical Corp.; black-out sheet 32 also manufactured by Oxidental Chemical Corp., 2.5 to 3.5 mil; and non-stretchable woven mesh fiberglass sheet 34 manufactured by Clarke Schwebel Fiberglass Co. under Model 1610.

Figure 3A:
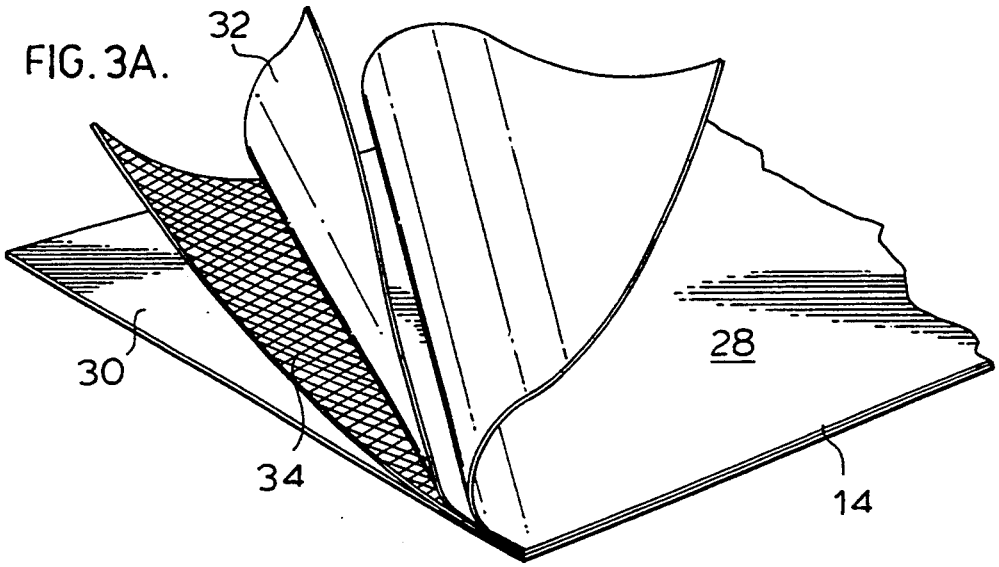
FIG. 3A is a close up view of the four layers forming the laminate of the blind of FIG. 1 separated from one another according to an embodiment of the invention.
Figure 3B:
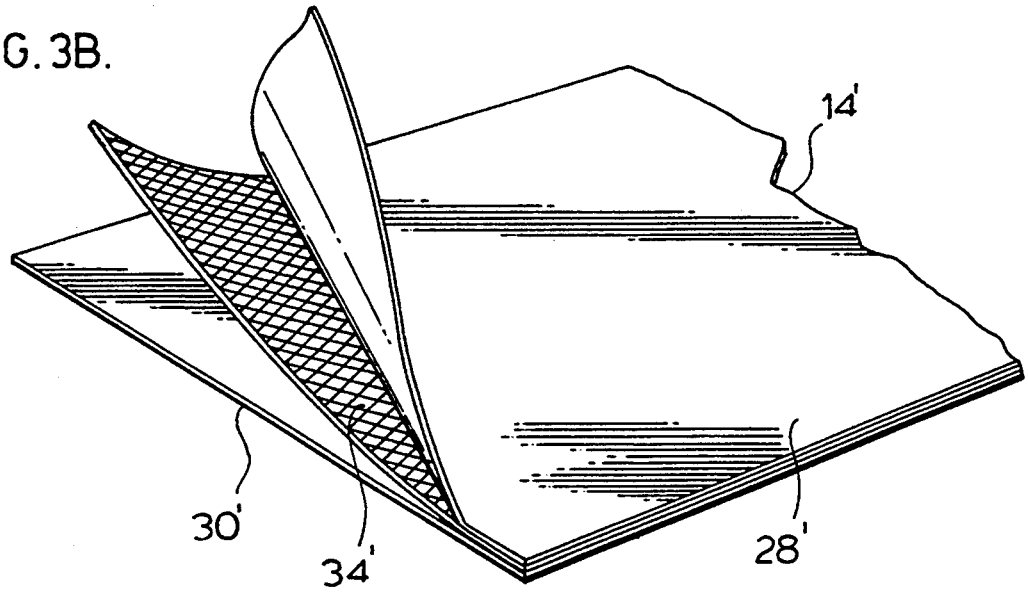
FIG. 3B is a close up view of three layers suitable for use in a blind similar to FIG. 1.

The shade 14' in FIG. 3B comprises outer sheets of PVC material 28' and 30' of PVC and non-stretchable woven mesh fiberglass 34'. It may be substituted for sheet 14 in the blind (shade) shown in FIG. 1. The sheets in both cases are laminated together in the manufacture of the shade 14 by heat, pressure and glue. In this regard and with reference to FIG. 4, rolls 35 and 37 of PVC 39 (manufactured by Oxidental Chemical Corp.) are carried on rollers 36 and 38 respectively. PVC 39 from each of rolls 35 and 37 are fed between master drum roller 44 made of steel and smaller compression roller 42 made of rubber. Black-out material 45 carried on roll 47 manufactured by Oxidental Chemical Corp., carried on roller 46 is fed into tray 48 containing liquid adhesive 50 to apply a layer of adhesive to face 52 of the continuous black out sheet 45 fed from roll 47.

Continuous sheet 60 of woven fiberglass (having spaced openings see FIGS. 3A and 3B (as 34 and 34' respectively) fed from roll 62 carried on roller 64 is fed between the sheet 39 from roll 37 and black-out sheet material 45 fed from roll 47. Thus when the materials are fed between drum roller 44 and roller 42, the materials are compressed together securing black-out material 45, from roll 47 and PVC material 39 from roll 35 (by glue). Heat generated from drum roller 44 melts some of the PVC material of PVC 39 from rolls 35 and 37 some of which from material 39 from roll 37 passes through the woven fiberglass material 60 adhering to black-out sheet from roll 47. The assembly is then passed between compression rollers 70 and 72 to assist to laminate the materials into one continuous material laminate 13 from which each shade (blind) 14 is made. The laminate is then taken up on a rewind roller 90, after passing around roller 92 and between roller 94 and drum 96, for storage purposes. As roller drum 96 rotates, rewind roller 90 is driven by engagement of the laminate with driven drum 96 to cause the take-up of laminate 13 onto roller 90 supported in spaced arms 100 and 102. When roller 90 is full, another roller may be inserted between spaced arms 104 and 106 to take up laminate 13.

Figure 5:
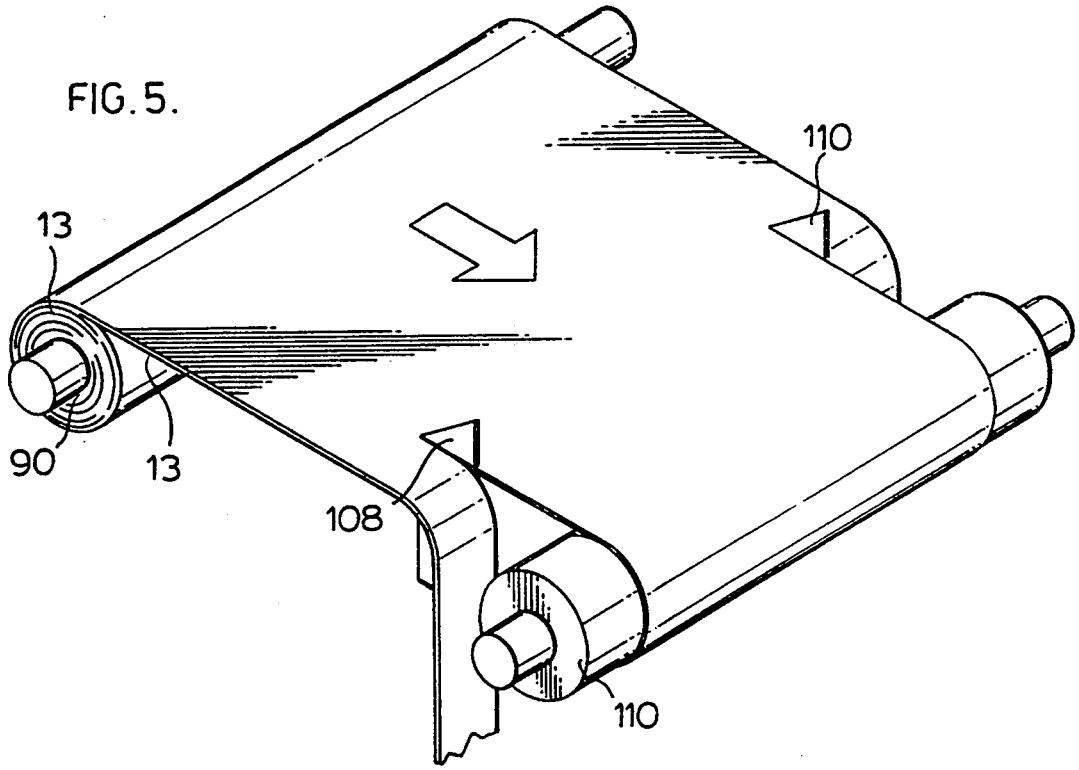
FIGS. 5 & 6 illustrate schematically the cutting of the rolls manufactured by the process illustrated in FIG. 4 into sheets of laminate to be assembled into the roller blind (shade) shown in FIG. 1.
Figure 6:
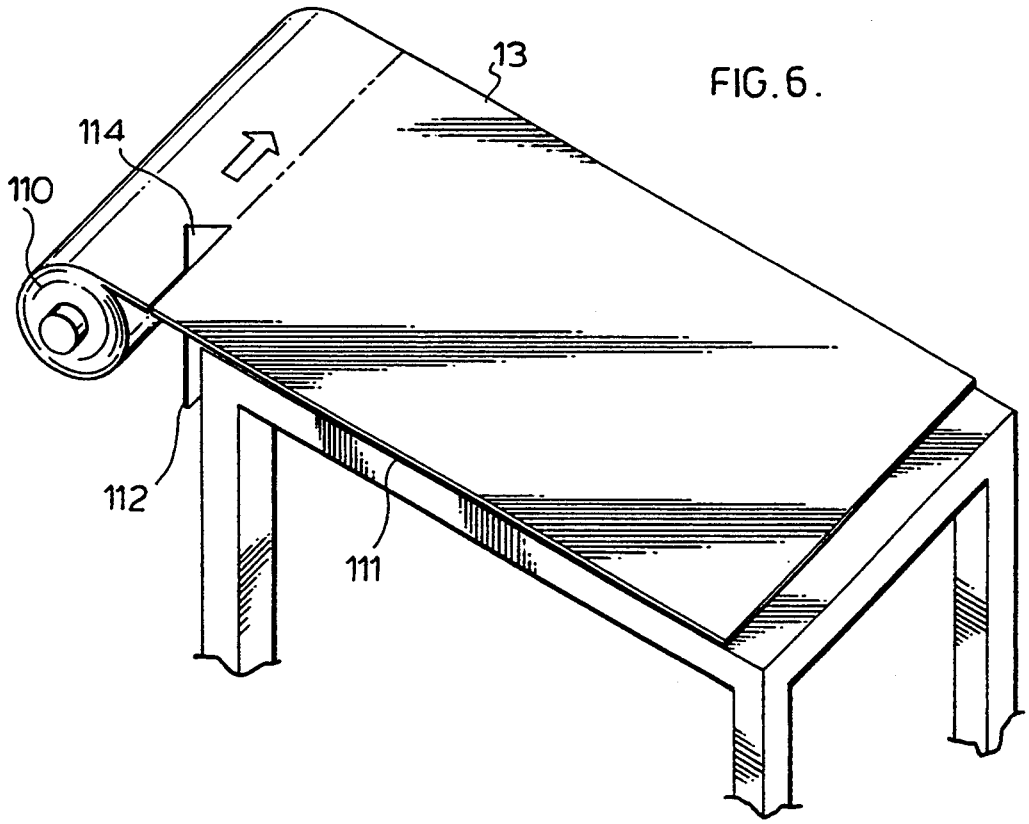

The sheet laminate 13 on the roller 90 may then be cut to size as shown in FIG. 5 (width-e.g. 36") and in FIG. 6 (length-e.g. 72") by knives as shown. In this regard rewind roller 90 carries roll of laminate 13 which is transferred to roller 110. During the transfer, the laminate is sized by slitting knives 108 and 110 as to width. The laminate sized to width is then sized as to length. In this regard, laminate 13 from roll 110 is placed on the top 111 of table 112 whereupon it is slit by knife 114 to the appropriate length of laminate (for example 72").

Figure 7A:
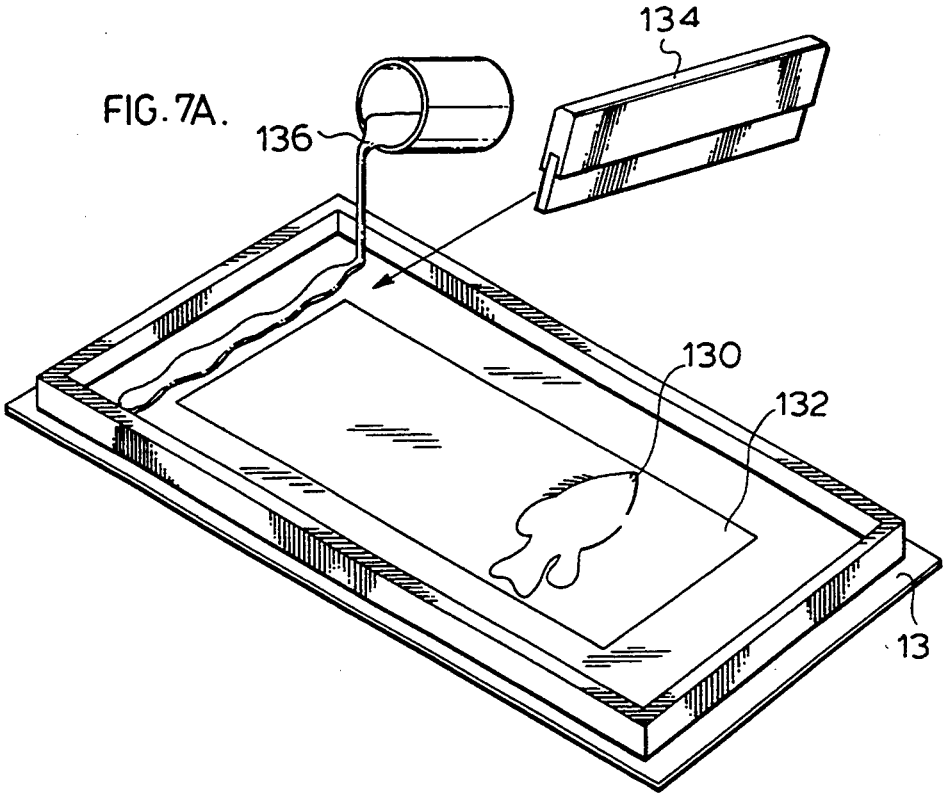
FIGS. 7A, 7B, 7C, 7D, 7E and 7F illustrate the silk screening of the various colours to form the colour picture of the fish shown in FIGS. 1 and 2, a high definition picture, onto the sheet of laminate of the shade or blind cut by FIGS. 5 and 6 used in the assembly of the roller shade (blind) of FIG. 1 according to an embodiment of the invention.
Figure 7B:
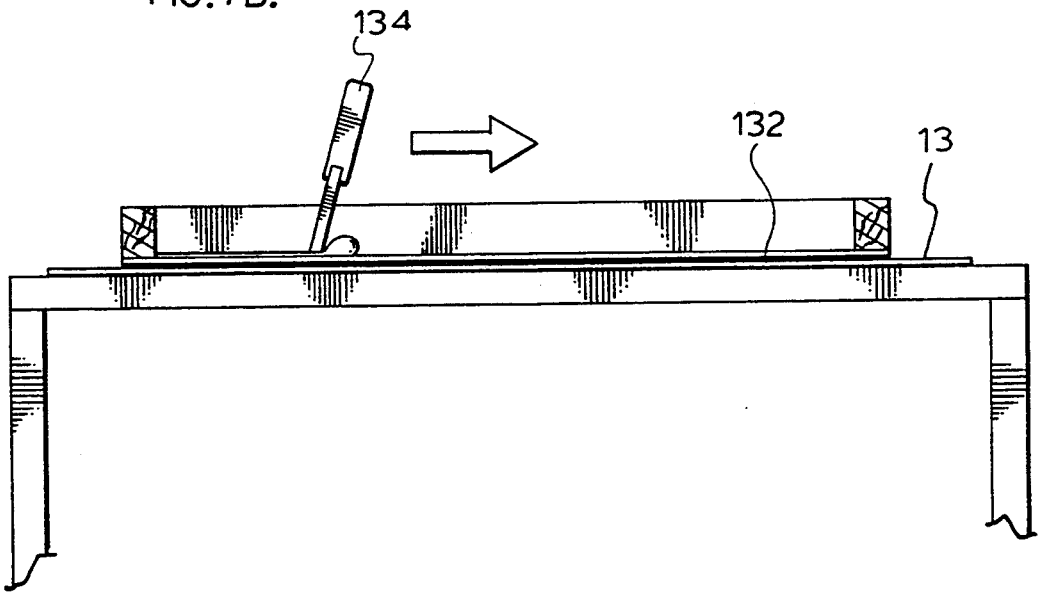
Figure 7C:
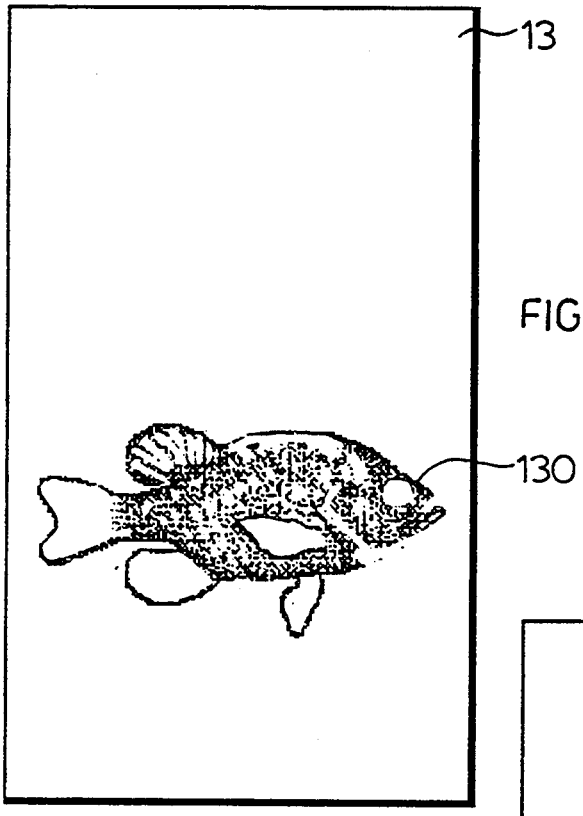
Figure 7D:
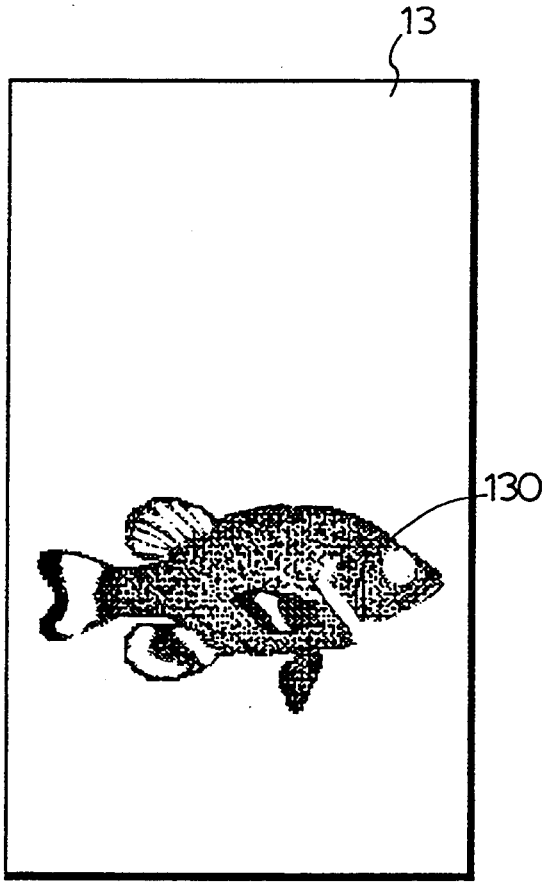
Figure 7E:
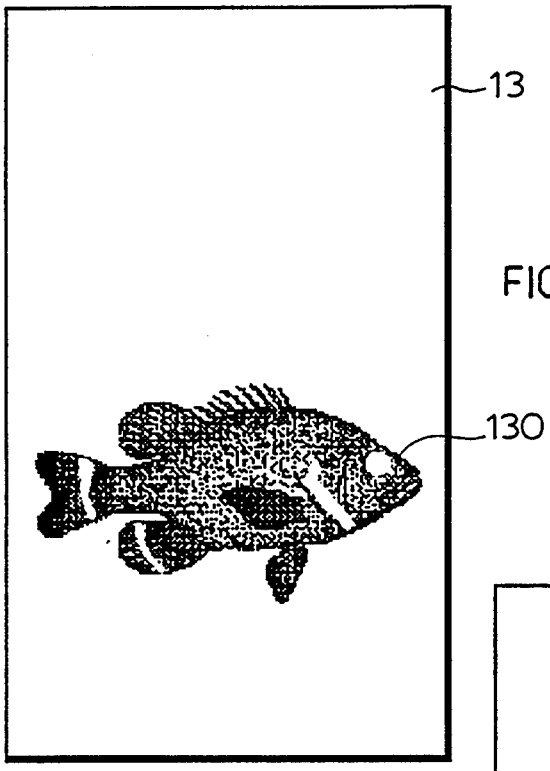
Figure 7F:
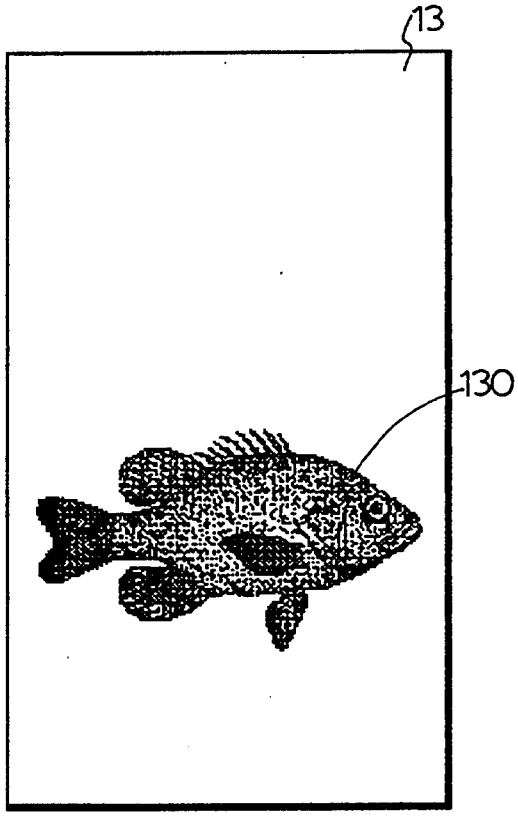

Those sized sheets may then be silk screened (with for example the high definition picture shown in FIG. 1 of a Fish). In this regard and with reference to FIGS. 7A and 7B, each sheet 14 may be silk screened with the appropriate colours making up the picture (or photograph), in this case the fish, shown in FIGS. 1 and 2. With reference to FIG. 7A the appropriate silk screen 132 of the fish 130 is positioned for a specific colour on laminate 14 of the blind. After the colour 130 is poured onto the screen, squeegee 134 is drawn along screen 132 (see FIG. 7B). The one colour then appears in the picture of fish 130 on laminate 14. (See FIG. 7C). For each colour a separate screen has been prepared and the appropriate colour is applied in the same manner as shown in FIGS. 7A and 7B. Thus with reference to FIGS. 7D, 7E and 7F different colours are added sequentially to produce the high definition picture of the fish on laminate 14, to complete the fish 130.

The sized shade (blind) 14 bearing the complete high definition picture in colour of fish 130 (see FIGS. 7A to 7E) is secured to roller 12 to form roller window shade 10 in FIG. 1.

Figure 4:
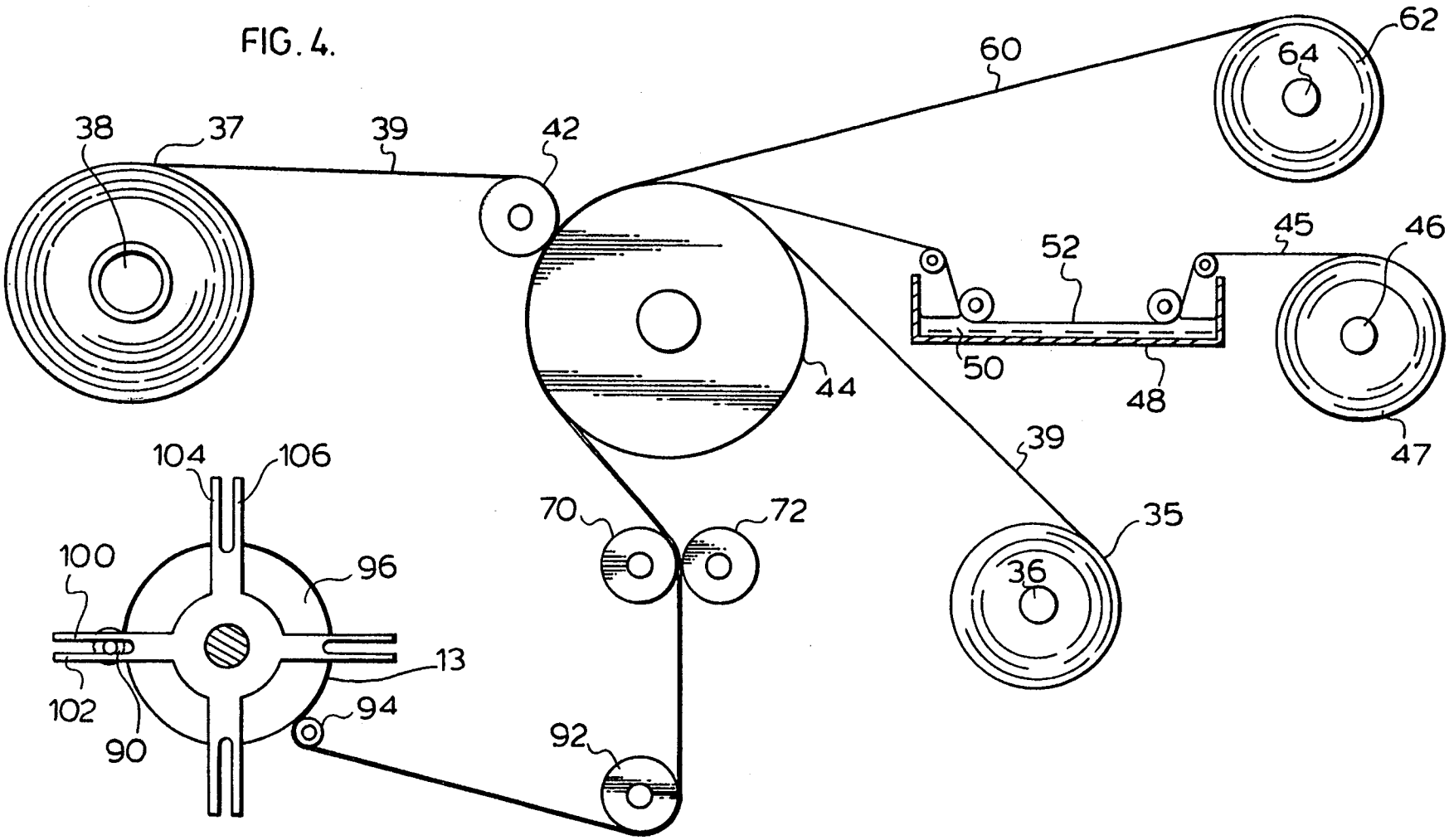
FIG. 4 is a schematic of components illustrating the process used to manufacture laminated rolls of shade (blind) cloth material or fabric used to manufacture (assemble) the laminate used in the manufacture of the blind of FIG. 1 according to an embodiment of the invention and the laminate shown in FIG. 3A.
Figure 8:
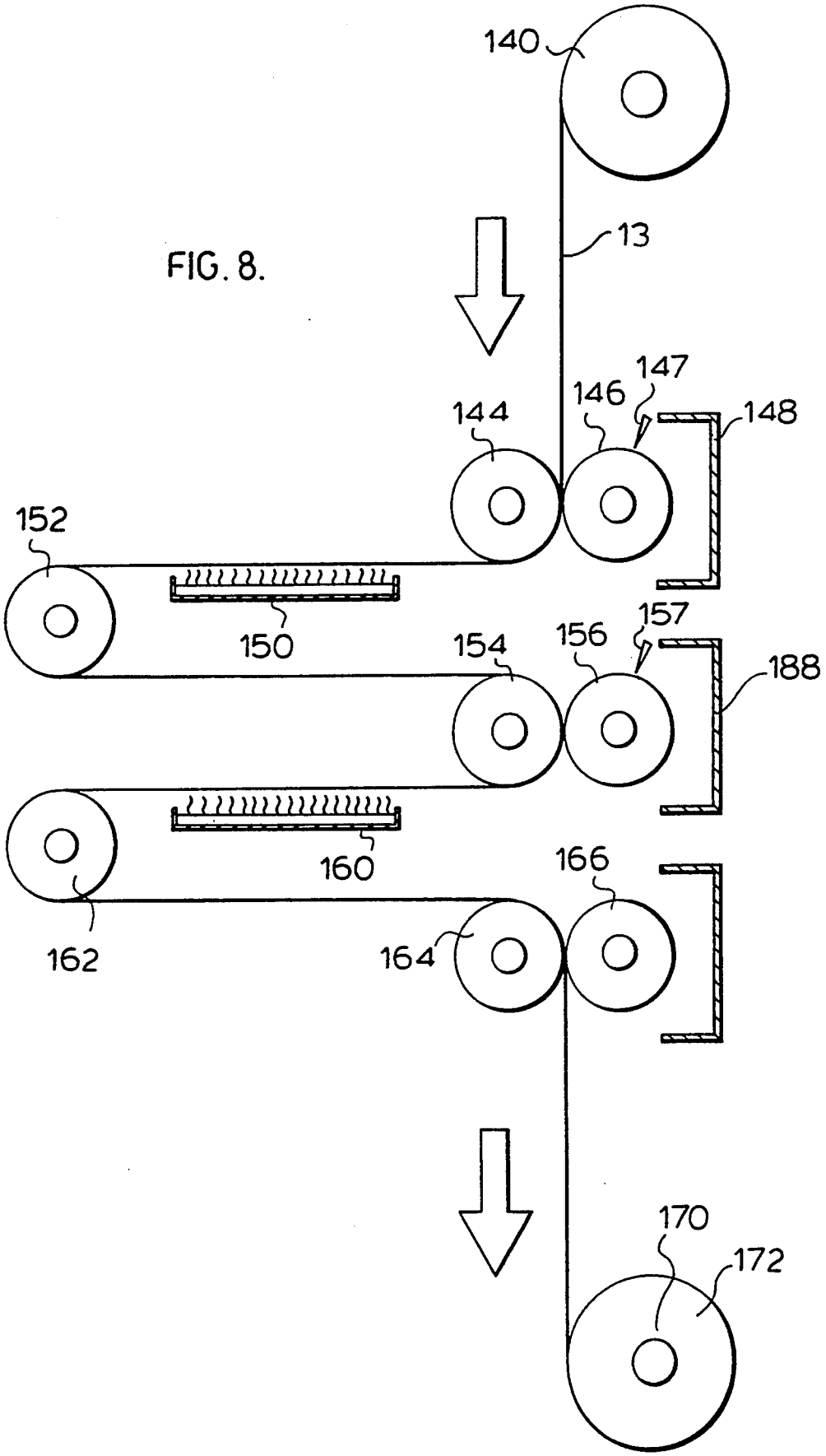
FIG. 8 illustrates the continuous application of a high definition picture to a continuous roll of shade (blind) laminate material manufactured by the process illustrated in FIG. 4 according to another embodiment of the invention.

With reference to FIG. 8, the roll of the laminate 90 produced by the process of lamination shown in FIG. 4, is printed by a rotary gravure process with the high definition picture of the fish 130 without distortion and with clarity. In this regard rewind roller 140 carries roll of laminate 13 which is fed between rollers 144 and 146 picking up colour ink from pick up roller 146 rotating through tray 148 of a specified colour and picking the colour up on specified portions of roller 146 (not shown) transferring the colour as predetermined to the laminate material 13 (a doctor blade 147 controls the amount of the colour ink picked up). The laminate is then transferred proximate to heater 150 where the colour is dried. The laminate then passes around roller 152 and passes between rollers 154 and 156 where a second amount of a different colour ink is laid down by roller 156 (picked up from tray 158) proximate the area where the first colour ink was applied to form another part of the coloured picture (of fish 130 see FIGS. 7C, 7D, 7E and 7F). Once again a doctor blade 157 controls the amount of ink carried by roller 156. The laminate 13 (bearing 2 colours) then passes heater 160 and the second application of ink dries. This procedure can be (and is) repeated any amount of times necessary to form the entire coloured picture, photograph, cartoon character, scene, logo, trade mark, icon and the like. The laminate 13 then passes around roller 162 between rollers 164 and 166 and is taken up on rewind or take up roller 170 to form roll 172. The roll 172 of laminate bearing the picture, photograph (fish) may be slit (see FIGS. 5 and 6) and then secured (as by tape or staples) to a roller (see FIG. 1 employing a clutch roller [for example constructed according to U.S. Pat. Nos. 5,029,629; 4,932,456; 5,167,269 and 5,137,073 and the prior art patents and publications cited in the prosecution of these patents] or spring roller 12A shown in FIG. 9) to form the roller window blind or shade 10.

During the carrying out of the processes of depicting the picture of fish 130 by the methods of FIG. 7 and FIG. 8, the shade (blind) material 13 is not stretched (because of the layer of fiberglass carried in the laminate). The application of the picture, photograph, etc. can be applied neatly, and clearly, without distortion.

As many changes can be made to the invention without departing from the scope of the invention, it is intended that all material contained herein by interpreted as illustrative of the invention and not in a limiting sense.

The embodiments of the invention in which an exclusive property or privilege is claimed are as follows:

1. A roller window shade comprising:

(a) a roller; and (b) a shade secured thereto for being rolled up onto, and rolled down from the roller, the shade having a face which carries a clear, undistorted, high definition imprint selected from a photograph, picture, icon, logo, trade mark, cartoon character or scene, applied directly onto the face, the shade comprising non-stretchable material to make the window shade non-stretchable.

2. The roller window shade of claim 1 wherein the roller is selected from the group consisting of a multi-stop roller and a clutch assembly shade roller which is either pull chain or electrically operated.

3. The shade of claim 1 wherein the shade presents polyvinyl chloride material on both sides of the shade (blind) and non-stretchable material between the two sheets of polyvinyl chloride.

4. The shade of claim 2 wherein the shade presents polyvinyl chloride material on both sides of the shade and non-stretchable material between the two sheets of polyvinyl chloride.

5. The shade of claim 3 wherein the non-stretchable material comprises a woven fiberglass between the two sheets of polyvinyl chloride.

6. The shade of claim 4 wherein the non-stretchable material comprises a woven fiberglass between the two sheets of polyvinyl chloride.

7. The shade of claims 3, 4, 5, or 6 wherein a layer of black-out material is interposed between the non-stretchable material and a sheet of polyvinyl chloride for blocking light transmission.

8. The shade of claim 1 or 2 wherein the shade comprises a pair of opposing polyvinyl chloride sheets, a layer of woven fiberglass and black-out material between the pair of opposing polyvinyl chloride sheets to provide a non-stretchable shade secured to the roller.

* * * * *